US005877587A

United States Patent [19]

Trinchero et al.

[11] Patent Number: 5,877,587

[45] Date of Patent: Mar. 2, 1999

[54] INLINE ELECTRON GUN HAVING IMPROVED EXPANDED FOCUS LENS ELECTRODES

[75] Inventors: Olivier Pierre Trinchero, Dijon, France; David Arthur New, Mercerville, N.J.; Yves Pontaillier, Montmancon, France

[73] Assignee: Thomson Tubes and Displays, S.A., Boulogne Cedex, France

[21] Appl. No.: 432,443

[22] Filed: May 1, 1995

[30] Foreign Application Priority Data

Aug. 26, 1994 [FR] France ..... 94 10313

[51] Int. Cl.[6] ..... H01J 29/62

[52] U.S. Cl. ..... 313/414; 313/460

[58] Field of Search ..... 313/414, 448, 313/460, 451, 458

[56] References Cited

U.S. PATENT DOCUMENTS

| | | | |
|---|---|---|---|
| 4,388,552 | 6/1983 | Greninger | 313/414 |
| 4,626,738 | 12/1986 | Gerlach | 313/414 |
| 4,720,654 | 1/1988 | Hernqvist et al. | 313/414 |
| 4,800,318 | 1/1989 | Naiki | 313/414 |
| 5,581,147 | 12/1996 | Koh et al. | 313/414 |

FOREIGN PATENT DOCUMENTS

| | | | |
|---|---|---|---|
| 0 302 657 | 2/1989 | European Pat. Off. | H01J 29/50 |
| 2101805 | 1/1983 | United Kingdom | H01J 29/50 |

*Primary Examiner*—Frank G. Font
*Assistant Examiner*—Michael Day
*Attorney, Agent, or Firm*—Joseph S. Tripoli; Dennis H. Irlbeck

[57] ABSTRACT

An improved inline electron gun of the invention includes a plurality of electrodes spaced from three cathodes. The electrodes form at least a beam forming region and a main focus lens in the paths of three electron beams, a center beam and two side beams. The main focus lens is formed by the facing portions of two electrodes. The improvement comprises the facing portions of the main focus electrodes including a first part, and a second part positioned within the first part. The first part includes a single aperture therein. The second part includes three inline apertures therein. The first part includes four spaced ledges, and the second part is attached to the four ledges.

4 Claims, 4 Drawing Sheets

Fig. 2
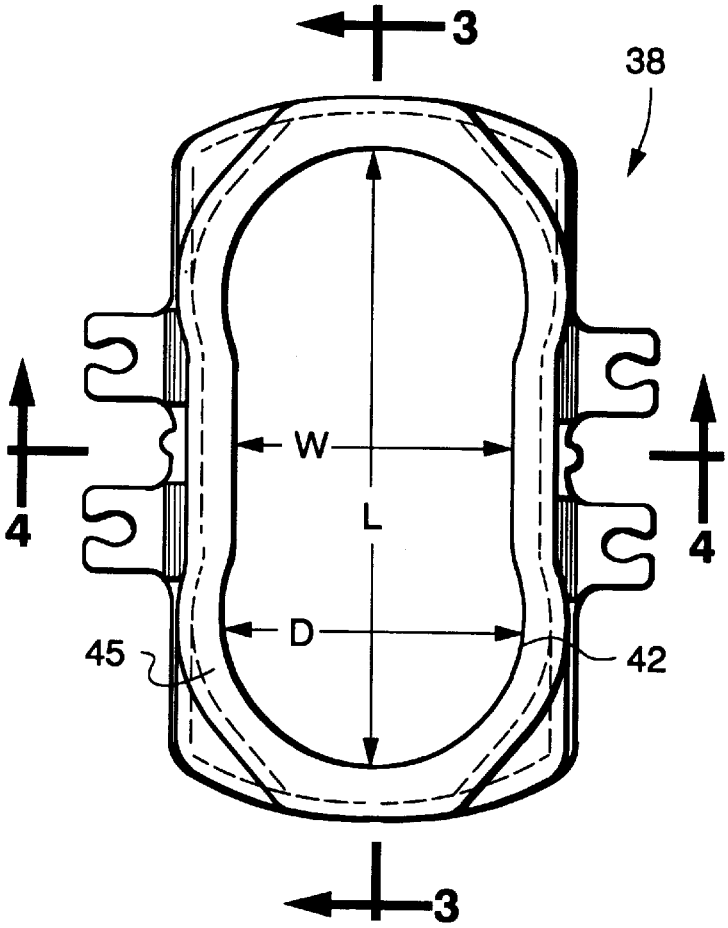
Fig. 3
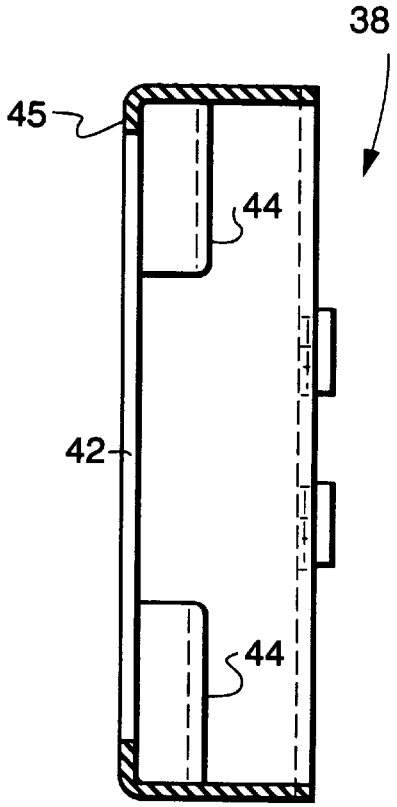
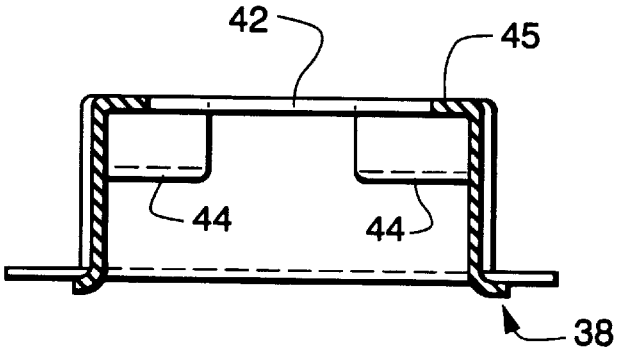
Fig. 4

Fig. 5
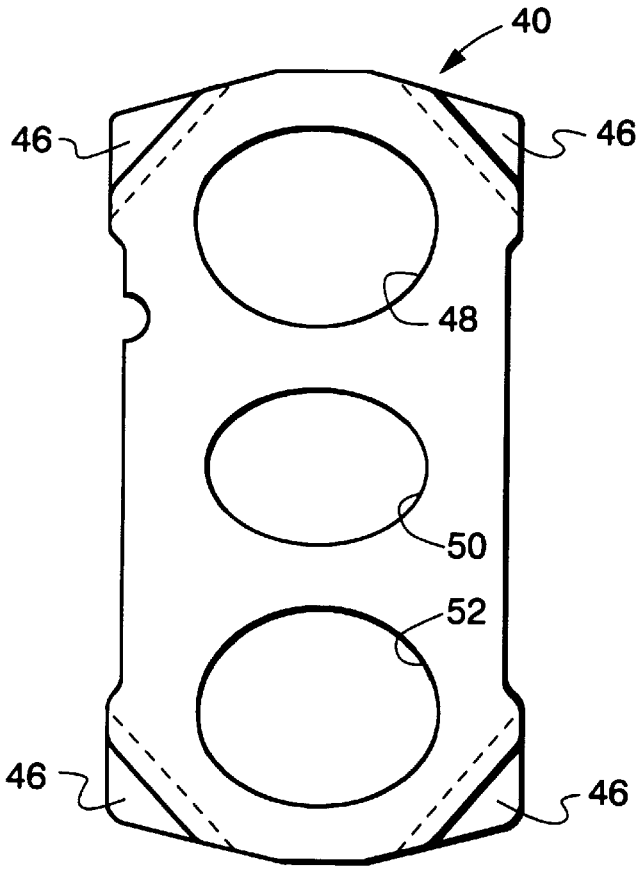
Fig. 6
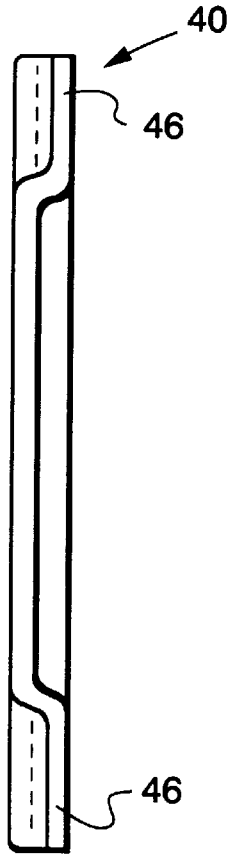
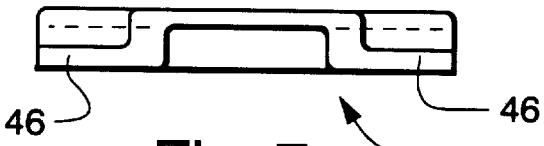
Fig. 7
Fig. 8
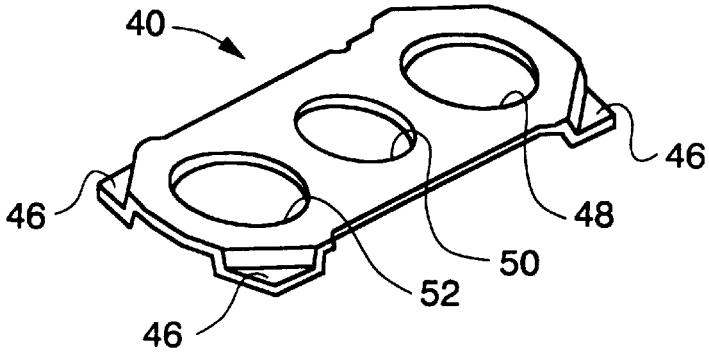

INLINE ELECTRON GUN HAVING IMPROVED EXPANDED FOCUS LENS ELECTRODES

The present invention relates to inline electron guns, such as used in color picture tubes, and particularly to such guns having improved structures in their main focus lens electrodes.

BACKGROUND OF THE INVENTION

An inline electron gun is one designed to generate or initiate preferably three electron beams in a common plane and to direct those beams along convergent paths to a point or small area of convergence near the tube screen. In U.S. Pat. No. 4,370,592, issued to Hughes et al. on Jan. 25, 1983, an electron gun is described wherein a main focusing lens is formed by two spaced electrodes. Each main focusing lens electrode includes a plurality of apertures therein, equal to the number of electron beams, and also a peripheral rim, with the peripheral rims of the two main focusing lens electrodes facing each other. The apertured portion of each main focusing lens electrode is located within a recess set back from the rim. The effect of this electrode structure on the main focusing lens is a gentle voltage gradient, for reducing spherical aberration.

U.S. Pat. No. 4,388,552, issued to Greninger on Jun. 14, 1983, discloses a modification in the shape of one of the peripheral rims of the above-described electron gun. In this modification, the recess in at least one of the electrodes is wider at the side beam paths than at the center beam path, measured perpendicular to the plane containing the inline electron beams. This modification redistributes the electrostatic field lines of the main focusing lens, so that the focus voltages for the three beams are unitized.

U.S. Pat. No. 4,626,738, issued to Gerlach on Dec. 2, 1986, discloses a main focusing lens formed by two electrodes, each of which includes an outer oval-shaped part with a peripheral rim. The rims of each electrode face each other. Telescoped within each oval-shaped part is an apertured plate that has a corresponding oval-shaped periphery. In this type of main lens construction, it has been found that the distance between the apertured plates and peripheral rims may vary unless extreme care is taken during fabrication of the electron gun. Furthermore, it is also possible to insert the apertured plates at an angle that is slightly out of alignment with the peripheral rims. The present invention provides an improved construction for the main focusing lens electrodes in the type of electron gun that utilizes such apertured plates.

SUMMARY OF THE INVENTION

The improved inline electron gun of the invention includes a plurality of electrodes spaced from three cathodes. The electrodes form at least a beam forming region and a main focus lens in the paths of three electron beams, a center beam and two side beams. The main focus lens is formed by the facing portions of two electrodes. The improvement comprises the facing portions of the main focus electrodes including a first part, and a second part positioned within the first part. The first part includes a single aperture therein. The second part includes three inline apertures therein. The first part includes four spaced ledges, and the second part is attached to the four ledges.

BRIEF DESCRIPTION OF THE DRAWINGS

FIG. 2 is a front view of a first part of the G5 electrode of FIG. 1 that includes a rim.

FIG. 3 is a cross-sectional top view of the first part of the G5 electrode that includes a rim, taken at line 3—3 in FIG. 2.

FIG. 4 is a cross-sectional side view of the first part of the G5 electrode that includes a rim, taken at line 4–4 in FIG. 2.

FIG. 5 is a front view of a second part of the G5 electrode that includes three apertures.

FIG. 6 is a top view of the second part of the G5 electrode of FIG. 5.

FIG. 7 is a side view of the second part of the G5 electrode of FIG. 5.

FIG. 8 is a perspective view of the second part of the G5 electrode that includes three apertures.

DETAILED DESCRIPTION OF THE PREFERRED EMBODIMENT

Figure 1:
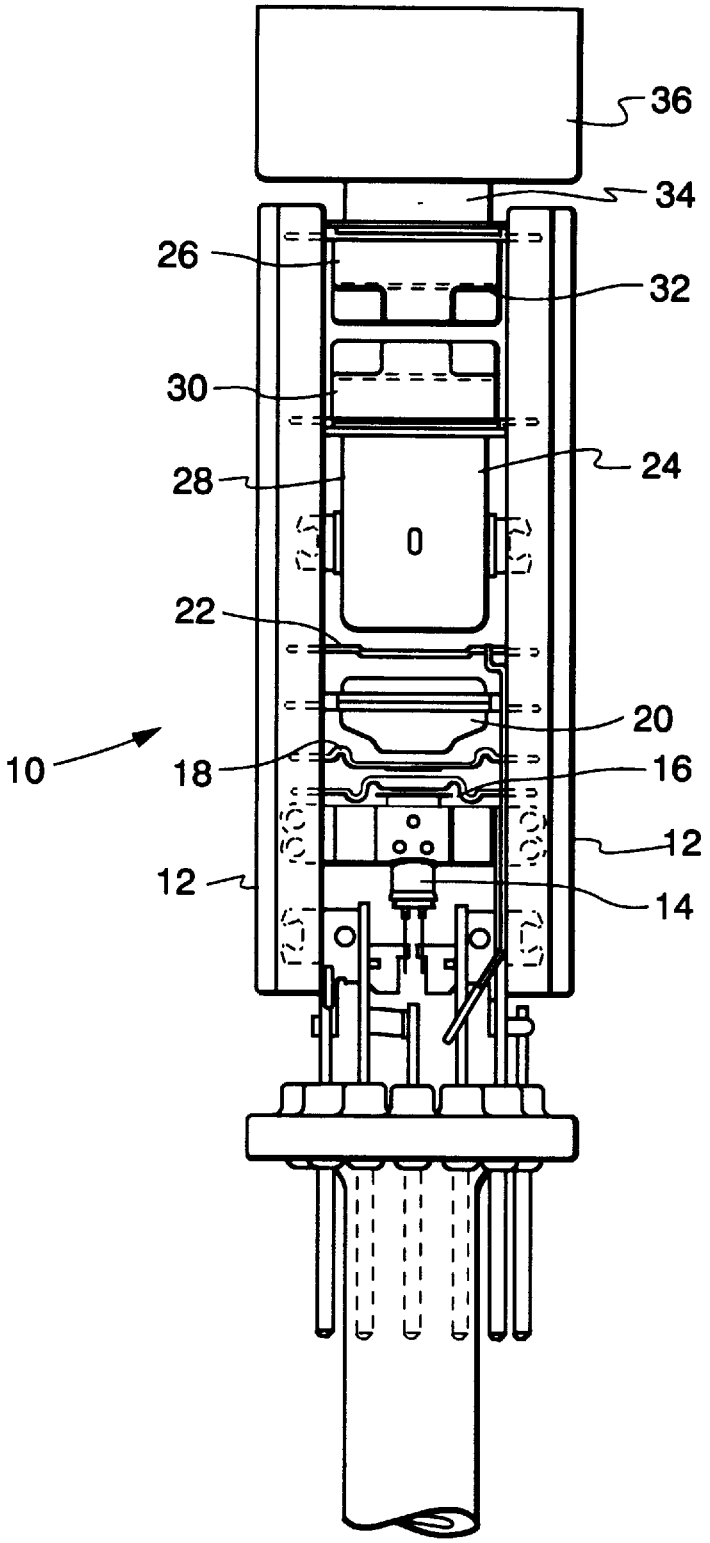
FIG. 1 is a side view of an electron gun incorporating an embodiment of the present invention.

In detail, an electron gun 10, shown in FIG. 1, comprises two insulative support rods 12 on which various electrodes are mounted. These electrodes include three equally spaced coplanar cathodes 14 (one shown), a control grid electrode 16 (G1), a screen grid electrode 18 (G2), a first prefocus electrode 20 (G3), a second prefocus electrode 22 (G4), a combined third prefocus electrode and first main focus electrode 24 (G5) and a second main focus electrode 26 (G6), spaced along the glass rods 12 in the order named. Each of the G1 through G6 electrodes has three inline apertures therein, or at each end thereof, to permit passage of three coplanar electron beams. The main electrostatic focusing lens in the gun 10 is formed between the G5 electrode 24 and the G6 electrode 26. The G5 electrode 24 also may be referred to as the focus electrode, because a focus voltage is applied to it, and the G6 electrode 26 may be referred to as the anode electrode, because an anode voltage is applied to it. The G5 electrode 24 is formed with two cup-shaped elements, 28 and 30, that are connected at their open ends. The G6 electrode 26 is formed with two cup-shaped elements, 32 and 34, that also are connected at their open ends. A shield cup 36 is attached to the element 34 at the exit of the electron gun.

All of the electrodes of the electron gun 10 are either directly or indirectly connected to the two insulative support rods 12. The rods may extend to and support the G1 electrode 16 and the G2 electrode 18, or these two electrodes may be attached to the G3 electrode 20 by some other insulative means. Preferably, the support rods are of glass which has been heated and pressed onto claws extending from the electrodes, to embed the claws in the rods.

The facing portions, elements 30 and 32, of the G5 electrode 24 and the G6 electrode 26, respectively, are identical. Therefore, only the element 30 is described in detail, as follows.

The element 30 includes two parts, 38 and 40. As shown in FIGS. 2, 3 and 4, the part 38 is somewhat cup-shaped, with a large aperture 42 in its closed end. The aperture 42 is elongated in the inline direction of the inline electron beams and is slightly wider perpendicular to the inline direction of the inline electron beams at the two outer or side beam paths. Within the art, the shape of the aperture 42 is known as a "dogbone" shape. At the side beam paths, the aperture 42 is circularly shaped with a diameter "D". At the center beam path, the aperture 42 has straight sides separated by a width "W". The length "L"of the aperture 42 extends through the beam paths from one end of the aperture to the other.

The aperture 42 is peripherally surrounded by a rim 45. The four corners of the part 38 are counter-stamped, to form a shelf or ledge 44 at each corner in the inside of the part.

The height of the ledges 44 can be varied, during the counter-stamping step, to adjust the spacing in the electron gun between the two facing parts 40.

As shown in FIGS. 5, 6, 7 and 8, the part 40 is generally a flat plate with an offset at each of its four corners 46. The amount of offset of the four corners 46 also can be varied to adjust the spacing in the electron gun between the two facing parts 40. The part 40 has three inline apertures, 48, 50 and 52. The center aperture 50 has an elliptical shape, and the two side apertures 48 and 52 have more complex shapes, with the inside portions of the side apertures being circular and the outside portions being elliptical.

Figure 9:
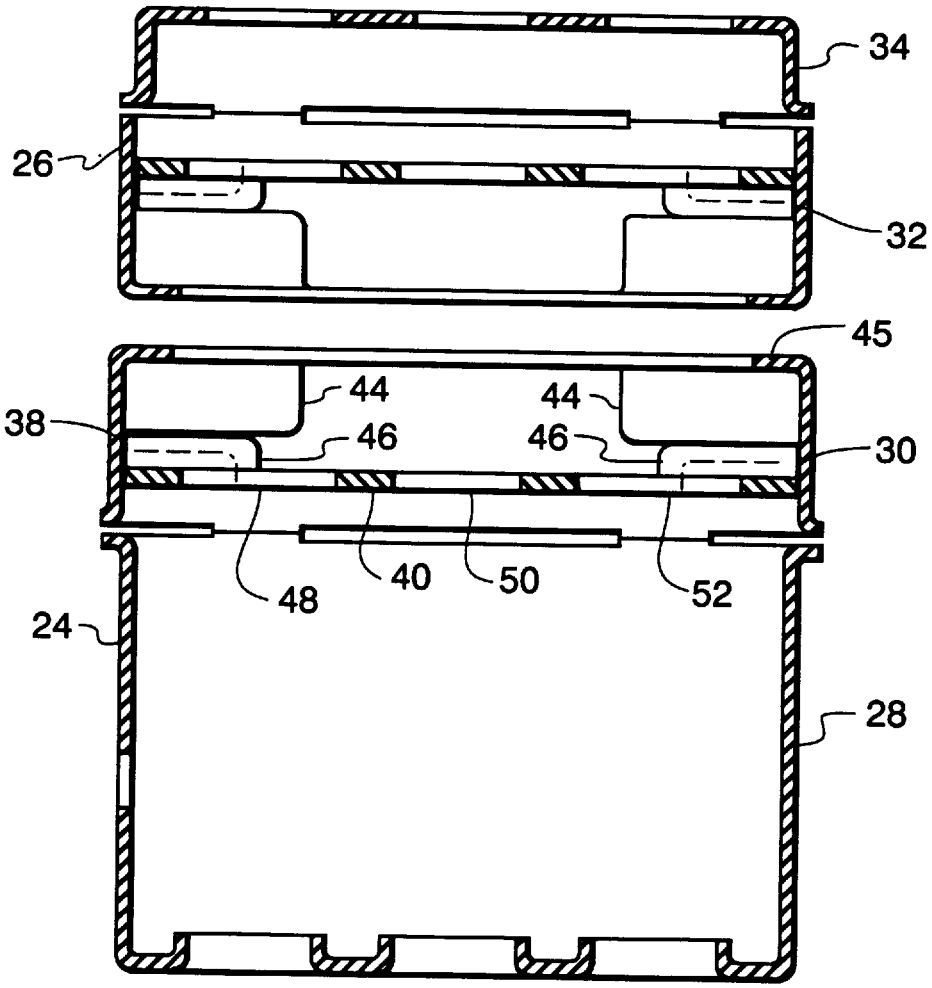
FIG. 9 is a cross-sectional top view of the G5 and G6 electrodes of the electron gun of FIG. 1.

The G5 electrode 24 is completed by placing the four offset corners 46 of the part 40 into contact with the four ledges 44 of the part 38 and welding the corners 46 to the shelves 44, as indicated in FIG. 9, which show the electrode structure forming the main focusing lens.

A disadvantage of using only one dogbone-shaped recess in the electrode that is connected to anode voltage (anode electrode), as shown in the above-referenced U.S. Pat. No. 4,388,552, is the high sensitivity of the electrode to dimensional changes. The following TABLE I gives examples of modifications of the dogbone dimensions that are required for various sets of astigmatism (Ast.) and free beam landing adjustment (FBL).

TABLE I

| Δ Ast. Green (Volts) | Δ Ast. Red (Volts) | Δ FBL (mm) | Δ L (mm) | Δ W (mm) | Δ D (mm) |
|---|---|---|---|---|---|
| 100 | 100 | 0 | −0.013 | −0.038 | −0.064 |
| 100 | 0 | 0 | −0.013 | −0.038 | −0.013 |
| 100 | 0 | 0.254 | −0.025 | −0.038 | −0.025 |

As can be seen in TABLE I, the structural changes in the anode electrode that are necessary to correct for astigmatism and free beam landing are relatively small, ranging from 0.013 mm to 0.064 mm. The achievement of such small dimensional changes requires a high level of precision in tooling and manufacturing. Therefore, it is very desirable to modify the structure of the electron gun, to decrease this high sensitivity to structural changes. The embodiment of the invention described herein solves this problem of high sensitivity by making the facing portions of the focus electrode and the anode electrode with identical features. The focus electrode is located in the converging portion of the main focus lens, and the anode electrode is locating in the diverging portion of the main focus lens. Because of these locations, identical changes made on both the focus electrode and the anode electrode produce opposite effects in each of these electrodes. For example, consider the three sets of astigmatism and free beam landing conditions given in TABLE I. If the focus electrode is changed to a dogbone shape, the dimensional changes that would be required in the focus electrode dogbone to provide the same correction as did the changes in the anode electrode dogbone are as shown in TABLE II.

TABLE II

| Δ Ast. Green (Volts) | Δ Ast. Red (Volts) | Δ FBL (mm) | Δ L (mm) | Δ W (mm) | Δ D (mm) |
|---|---|---|---|---|---|
| 100 | 100 | 0 | 0.013 | 0.025 | 0.051 |
| 100 | 0 | 0 | 0.0 | 0.025 | 0.0 |
| 100 | 0 | 0.254 | 0.025 | 0.025 | 0.013 |

By comparing the dimensional changes required in TABLE I and TABLE II, it can be seen that the changes are of approximately equal magnitude, but of different sign. TABLE III gives the dogbone dimensional changes required to provide the same astigmatism corrections as in TABLE I and TABLE II, for an electron gun having identical dogbone shapes in both the focus and anode electrodes.

TABLE III

| Δ Ast. Green (Volts) | Δ Ast. Red (Volts) | Δ FBL (mm) | Δ L (mm) | Δ W (mm) | Δ D (mm) |
|---|---|---|---|---|---|
| 100 | 100 | 0 | 0.000 | 0.152 | 0.229 |
| 100 | 0 | 0 | 0.025 | 0.152 | 0.000 |
| 100 | 0 | 0.254 | 0.102 | 0.152 | 0.102 |

In TABLE III, it can be seen that the dimensional changes that are required for astigmatism and free beam landing correction when both the focus electrode and anode electrode have identical shapes, are substantially larger than those required when only one of the electrodes is modified. Because larger dimensional changes are required, the sensitivity to dimensional changes, of the electron gun having two identical dogbones, is much less than in an electron gun having only one dogbone.

What is claimed is:

1. In an inline electron gun, including a plurality of electrodes spaced from three cathodes, said electrodes forming at least a beam forming region and a main focus lens in the paths of three electron beams, a center beam and two side beams, and said main focus lens being formed by the facing portions of two of said electrodes, the improvement comprising said facing portions of the two main focus lens electrodes each including a first part having a single aperture therein, and a second part positioned within said first part, said second part including three inline apertures therein, and said first part including an apertured cup-shaped part with four spaced ledges, and said second part being an apertured plate with four corners, each corner including an offset, said apertured plate being attached to said four ledges at the offsets.

2. The electron gun as defined in claim 1, including the single aperture in said cup-shaped part of at least one of said two main focus lens electrodes having greater width at the side beam paths, measured in a direction that is perpendicular to the inline direction of said inline electron beams, than at the center beam path.

3. The electron gun as defined in claim 1, wherein said three inline apertures in said apertured plate are noncircular in shape.

4. The electron gun as defined in claim 1, wherein said first part of each of said facing portions of said two main focus lens electrodes are identical in size and shape and wherein said second part of each of said facing portions of said two main focus lens electrodes are identical in size and shape.

* * * * *